US012130115B2

(12) United States Patent
Smith et al.

(10) Patent No.: US 12,130,115 B2
(45) Date of Patent: Oct. 29, 2024

(54) MOLLE ADAPTER

(71) Applicant: Vista Outdoor Operations LLC, Anoka, MN (US)

(72) Inventors: Paul N. Smith, Bozeman, MT (US); Daniel Sereday, Belgrade, MT (US); Christopher J. Michael, Belgrade, MT (US); Troy E. Lance, Livingston, MT (US)

(73) Assignee: Vista Outdoor Operations LLC, Anoka, MN (US)

( * ) Notice: Subject to any disclaimer, the term of this patent is extended or adjusted under 35 U.S.C. 154(b) by 135 days.

(21) Appl. No.: 18/084,018

(22) Filed: Dec. 19, 2022

(65) Prior Publication Data

US 2023/0213309 A1 Jul. 6, 2023

Related U.S. Application Data

(63) Continuation of application No. 17/112,658, filed on Dec. 4, 2020, now Pat. No. 11,530,897.

(51) Int. Cl.
*F41C 33/04* (2006.01)
*A45F 5/02* (2006.01)

(52) U.S. Cl.
CPC ..... *F41C 33/041* (2013.01); *A45F 5/02* (2013.01)

(58) Field of Classification Search
CPC ..... F41C 33/041; A45F 5/02
See application file for complete search history.

(56) References Cited

U.S. PATENT DOCUMENTS

| | | | | |
|---|---|---|---|---|
| 7,007,352 | B1 | 3/2006 | Hil | |
| 8,297,562 | B1 | 10/2012 | Yeates et al. | |
| 8,523,029 | B2 | 9/2013 | Rogers et al. | |
| 9,797,679 | B2 | 10/2017 | Ponder | |
| 2012/0174341 | A1 | 7/2012 | Rogers et al. | |
| 2012/0175391 | A1 | 7/2012 | Rogers et al. | |
| 2014/0183233 | A1* | 7/2014 | Iannello | A45F 3/14 224/272 |
| 2015/0327658 | A1* | 11/2015 | Swan | A41D 13/0531 224/660 |

(Continued)

OTHER PUBLICATIONS

"Cytac MOLLE Holster Adapter for Magazine Holders", https://www.airsoftstation.com/cytac-molle-holster-adapter-for-magazine-holders/ (Accessed: Nov. 13, 2020).

(Continued)

*Primary Examiner* — Brian D Nash
(74) *Attorney, Agent, or Firm* — Reed Smith LLP; Matthew P. Frederick; Cheryl L. Gastineau

(57) ABSTRACT

An adapter assembly comprising an adapter plate and a retainer. The adapter plate comprises a substantially planar adapter body, a spaced pair of generally parallel upper for removably securing said adapter assembly to equipment, and a spaced pair of lower legs having a spaced pair of lower tines configured to have a gap there between, wherein the lower tines each comprise a ratchet tooth structure on an exterior surface thereof. The retainer is configured for slideable attachment to the lower tines and for spanning the gap between the lower tines, the retainer comprising a corresponding ratchet tooth on an interior surface thereof configured to engage with the ratchet tooth structure for a one-way slideable locking engagement of the retainer on the lower tines.

17 Claims, 10 Drawing Sheets

(56) References Cited

U.S. PATENT DOCUMENTS

| | | | | |
|---|---|---|---|---|
| 2018/0094892 | A1* | 4/2018 | Bowe, Jr. | F41A 23/18 |
| 2020/0141694 | A1 | 5/2020 | Tedder et al. | |
| 2020/0217613 | A1 | 7/2020 | Hatcher et al. | |
| 2021/0164610 | A1* | 6/2021 | Roth | H05K 5/0221 |
| 2022/0061506 | A1* | 3/2022 | Woodward | A45F 3/14 |
| 2022/0133008 | A1* | 5/2022 | Augustinowicz | A45F 5/004 150/147 |
| 2022/0178650 | A1* | 6/2022 | Smith | F41C 33/041 |

OTHER PUBLICATIONS

"Orpaz MOLLE Holster Adapter Attaches to all Orpaz Holsters and Pouches" https://www.walmart.com/ip/Orpaz-MOLLE-Holster-Adapter-Attaches-to-all-Orpaz-Holsters-and-Pouches/107922439 (Accessed: Nov. 13, 2020).

"APS Injection Molded MOLLE Compatible Belt Loop Adapter for APS Shotshell Caddy Systems" https://www.evike.com/products/59371/ (Accessed: Nov. 13, 2020).

* cited by examiner

MOLLE ADAPTER

CROSS REFERENCE TO RELATED APPLICATION

This application is a continuation of U.S. patent application Ser. No. 17/112,658 filed Dec. 4, 2020, the entire contents of which are incorporated herein by reference.

BACKGROUND OF THE DISCLOSURE

MOLLE is an acronym for Modular Lightweight Load-carrying Equipment. It is used to define the current generation of load-bearing equipment and backpacks used by a number of NATO armed forces, especially the British Army and the United States Army. The system's modularity is derived from the use of Pouch Attachment Ladder System (PALS) webbing equipment as rows of heavy-duty nylon stitched onto equipment to allow for the attachment of various compatible pouches and accessories. PALS is a grid of webbing used to attach smaller equipment onto load-bearing platforms, such as vests and backpacks. It was first used on MOLLE rucksacks, but is now found on a variety of tactical equipment, such as tactical vests. It is used to attach items such as holsters, magazine pouches, radio pouches, knife sheathes, and other gear.

PALS consists of webbing sewn onto the load-bearing equipment and corresponding webbing and straps on the attachment. The straps are interwoven between the webbing on each of two pieces, making for a very secure fit from which accessories can be detached with moderate effort. Some types are laser cut out of single piece fabric rather than webbing straps sewn onto fabric. The PALS grid consists of horizontal rows of 25 mm (1 in) A-A-55301A or Mil-W-43668 Type III nylon webbing (most commercial vendors use Type Ma), spaced 25 mm apart, and reattached to the backing at 38 mm (1.5 in) intervals. MOLLE/PALS systems may include variants to the typical width and spacing. Attachment mounts may be used to attach items to the MOLLE/PALS system. Typical attachment mounts are not adaptable to variants of the MOLLE/PALS system.

SUMMARY

In some embodiments, the adapter assembly comprises an adapter plate having a substantially planar adapter body, wherein the adapter body comprises a rear surface, a front surface, an upper portion, and a lower portion.

In some embodiments the adapter plate has a spaced pair of generally parallel upper arms integral with and extending downwardly from the upper portion of the adapter body in substantially the same plane as the adapter body for removably securing said adapter assembly to equipment, wherein the upper arms comprise an upper arm portion and a lower arm portion; wherein the upper arm portions are generally parallel with one another, and wherein the lower arm portion each have a narrowed portion and a hook portion, wherein the hook portion comprises a first portion extending frontward from a distal end of the narrowed portion and a second portion extending upwardly from the first portion; and In some embodiments the adapter plate has a spaced pair of lower legs integral with and extending downwardly from the lower portion of the adapter body in substantially the same plane as the adapter body, the spaced pair of lower legs comprising, an upper portion, and a lower portion comprising a spaced pair of generally parallel lower tines extending generally downwardly from the upper portion of the lower legs, the spaced pair of lower tines configured to have a gap there between, wherein the lower tines each comprise a ratchet tooth structure on an exterior surface thereof.

In some embodiments, a retainer is configured for slideable attachment to the lower tines and for spanning the gap between the lower tines, the retainer comprising a corresponding ratchet tooth on an interior surface thereof configured to engage with the ratchet tooth structure for a one-way slideable locking engagement of the retainer on the lower tines, wherein the retainer comprises an elongated clam shell body having a downwardly facing opening, wherein the retainer further comprises a through hole extending between front and rear surfaces thereof, and wherein the through hole is configured for receiving a locking screw.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
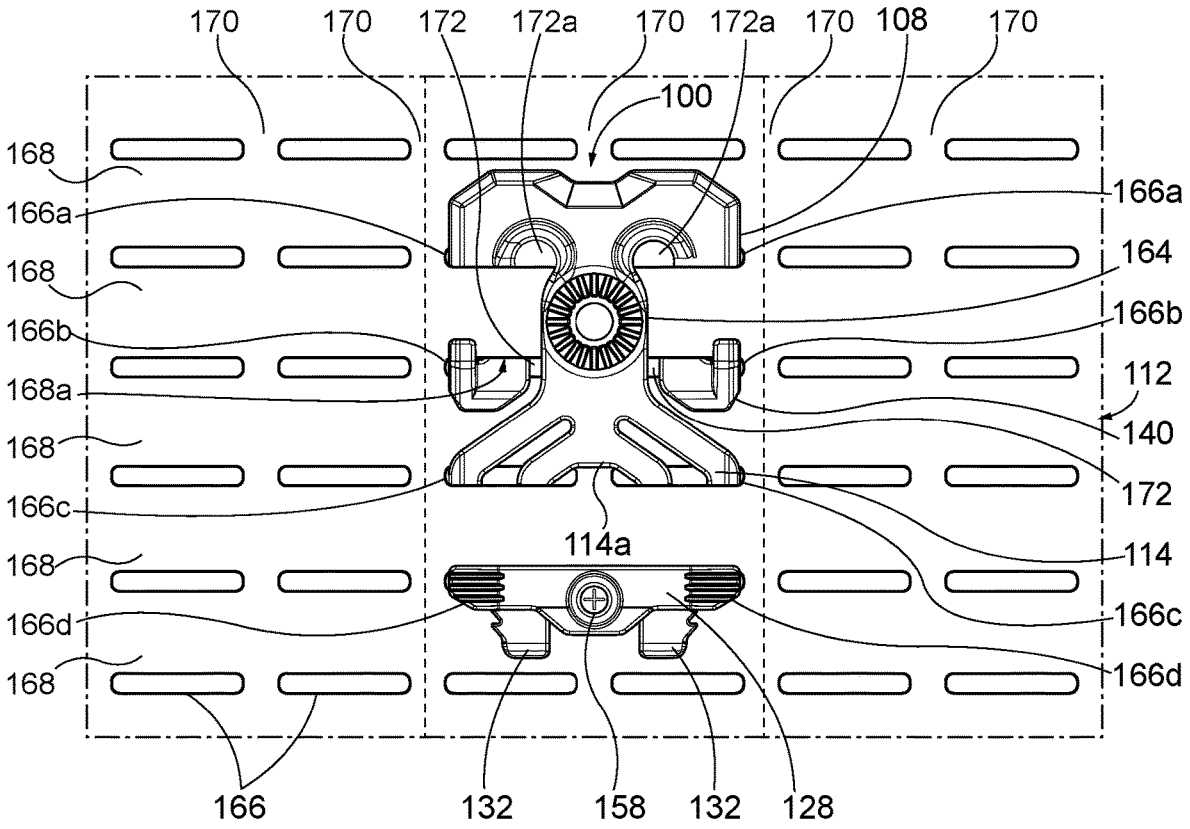
FIG. 1 is a front view of an embodiment of the adapter assembly according to an exemplary embodiment in a MOLLE/PALS system.
Figure 2:
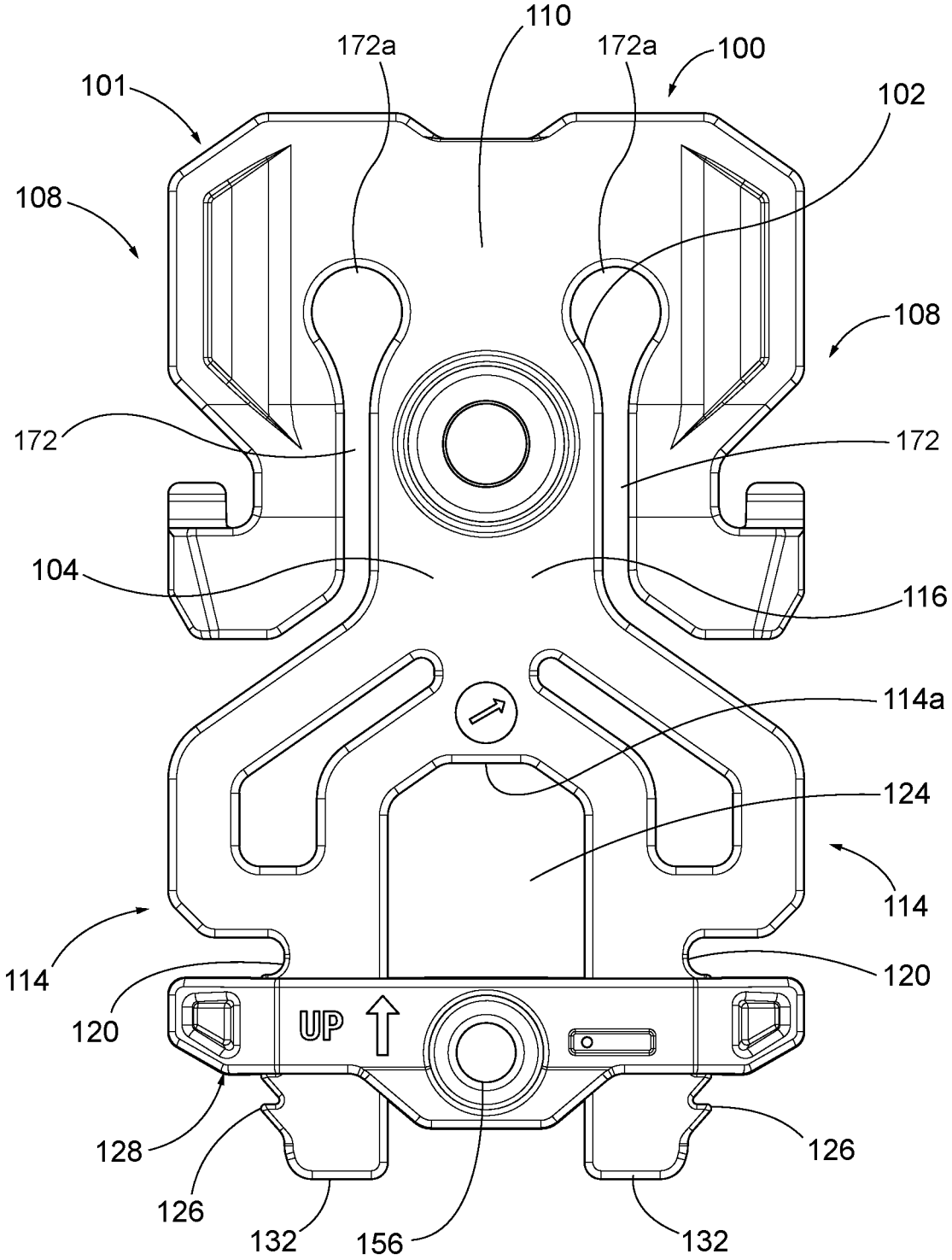
FIG. 2 is a rear view of the embodiment of the adapter assembly.
Figure 3:
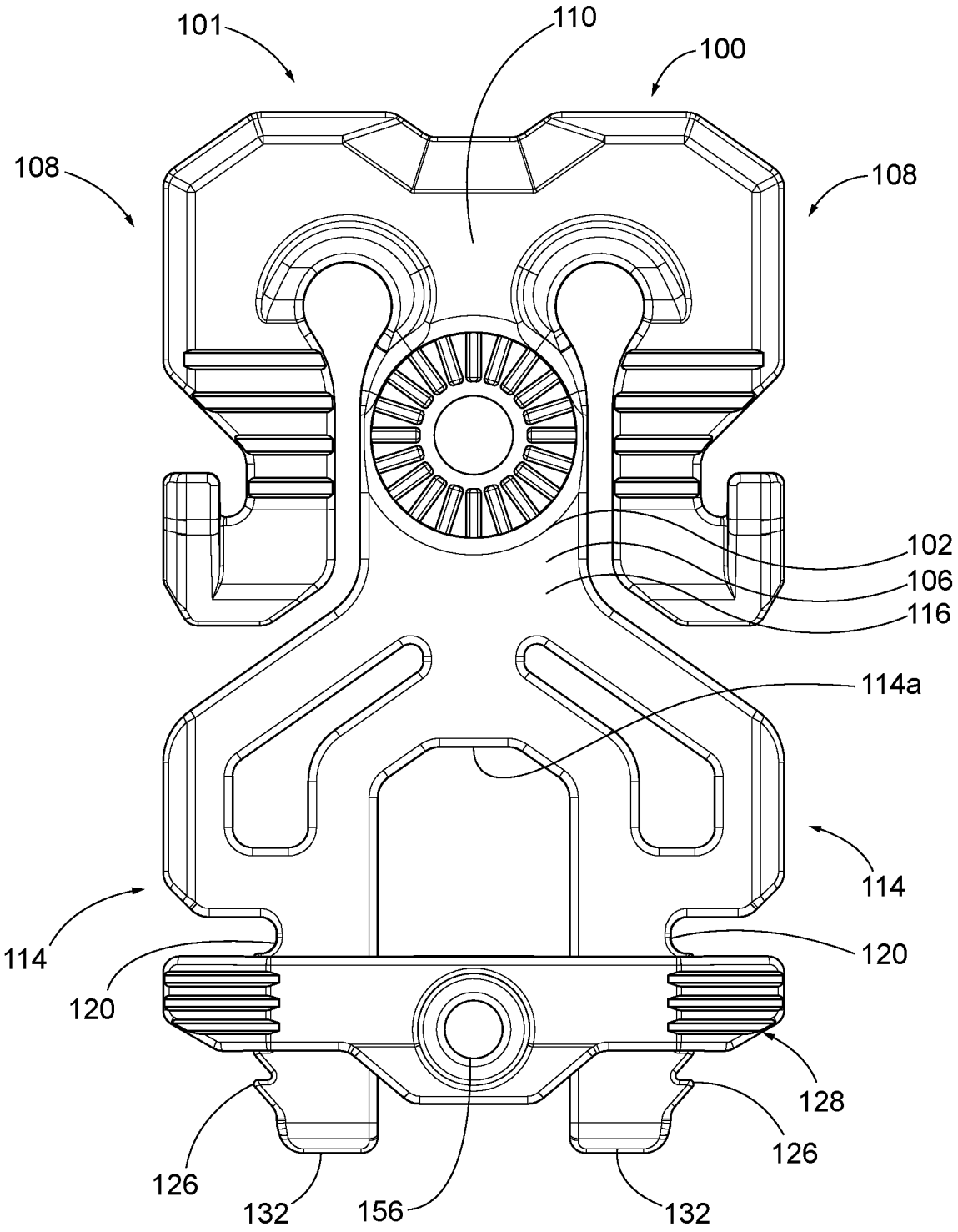
FIG. 3 is a front view of the embodiment of the adapter assembly.
Figure 4:
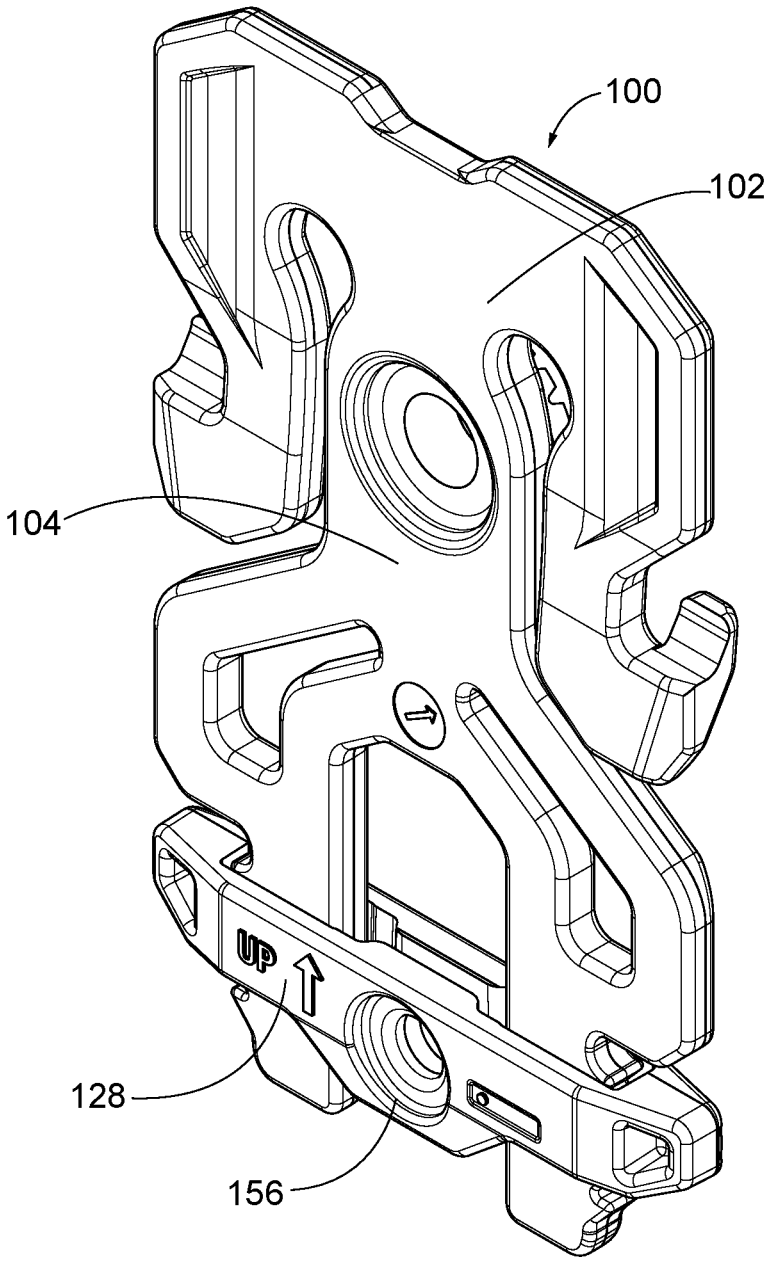
FIG. 4 is a rear, top, perspective view of the embodiment of the adapter assembly.
Figure 5:
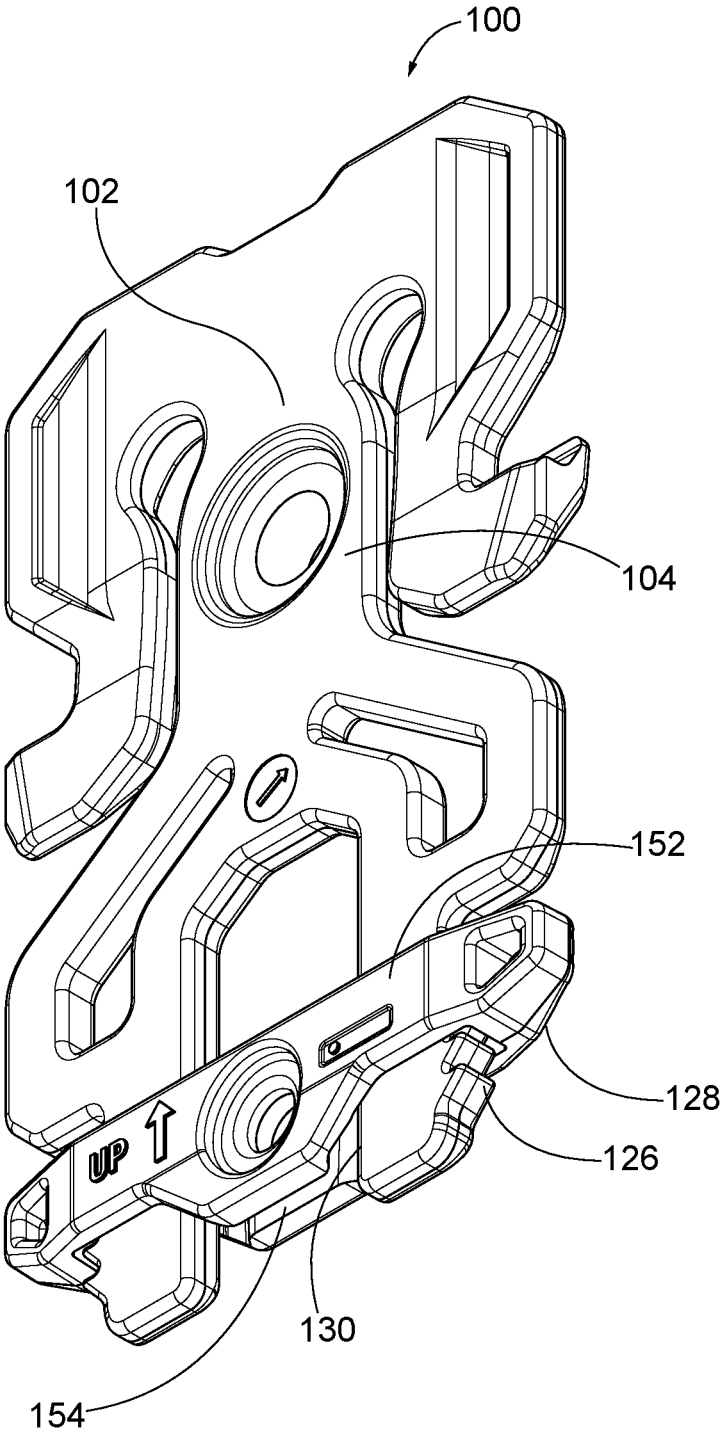
FIG. 5 is a front, bottom, perspective view of the embodiment of the adapter assembly.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIGS. 1-11 an adapter assembly 100 according to embodiments of the disclosure is shown. Adapter assembly 100 has an adapter plate 101 having a substantially planar adapter body 102 having a rear surface 104 and a front surface 106.

In some embodiments, adapter plate 101 has a spaced pair of generally parallel upper arms 108 integral with and extending downwardly from an upper portion 110 of the adapter body 102. In certain embodiments, upper arms 108 are in substantially the same plane as the adapter body 102 for removably securing said adapter assembly 100 to a MOLLE/PALS system 112, for example.

In some embodiments, adapter plate 101 also has a spaced pair of lower legs 114 integral with and extending downwardly from a lower portion 116 of the adapter body. In certain embodiments, the lower legs 114 are in substantially the same plane as the adapter body 102. In some embodiments, referring to FIG. 7, a lower portion 118 of the lower legs 114 forms a spaced pair of generally parallel lower tines 120 extending generally downwardly from an upper portion 122 of the lower legs 114, the spaced pair of lower tines 120 configured to have a gap 124 there between, wherein the lower tines 120 each comprise a ratchet tooth structure 126 on an exterior surface thereof, wherein the ratchet tooth structure 126 comprises at least one or a plurality of upwardly angled teeth, for example, five upwardly angled teeth. In some embodiments, the ratchet tooth structure 126 includes between one and ten teeth, and in other embodiments, between two and six teeth.

Figure 10:
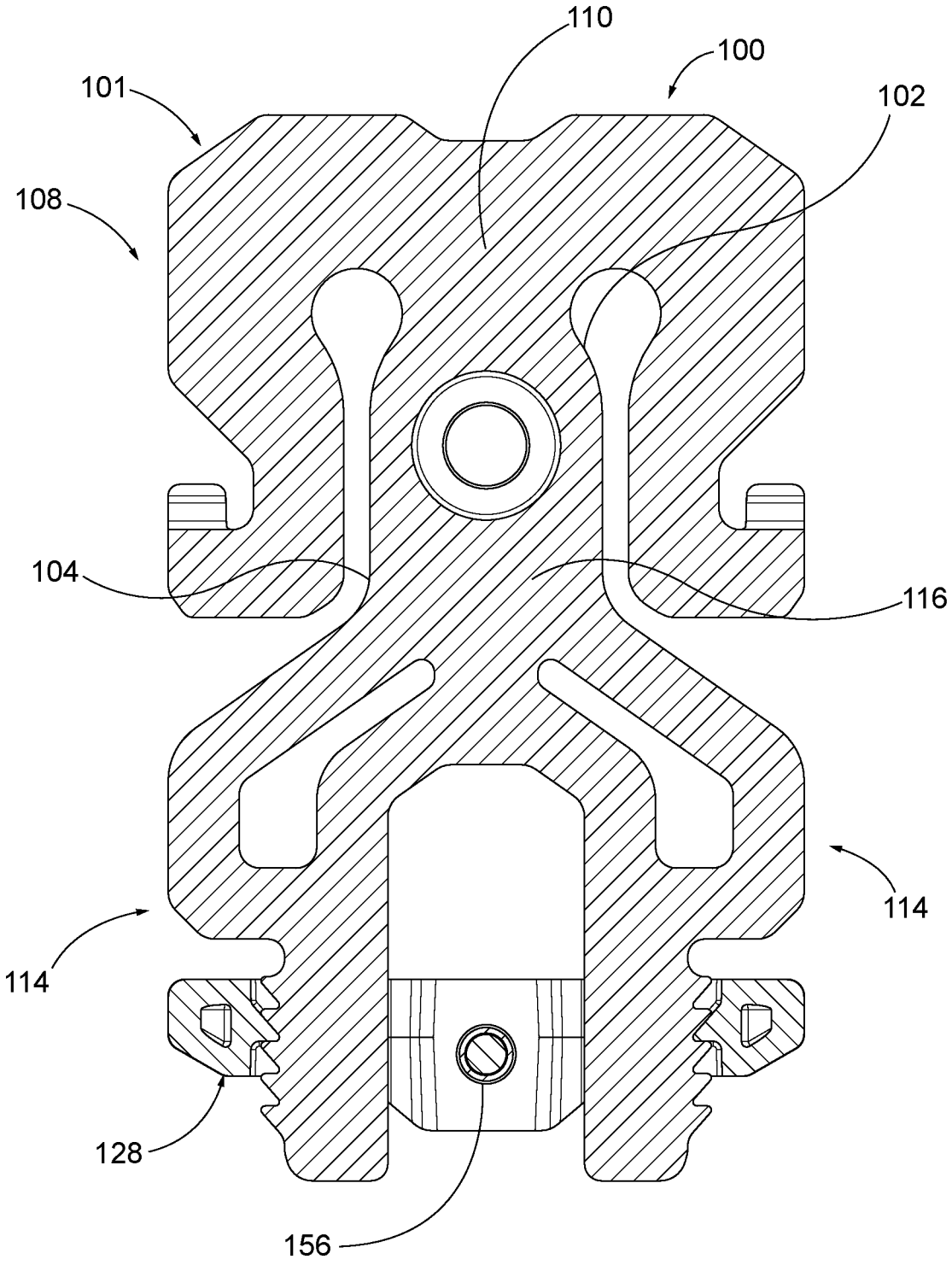
FIG. 10 is a cross-sectional view of the embodiment of the adapter assembly through line FIG. 10-FIG. 10 in FIG. 6.
Figure 11:
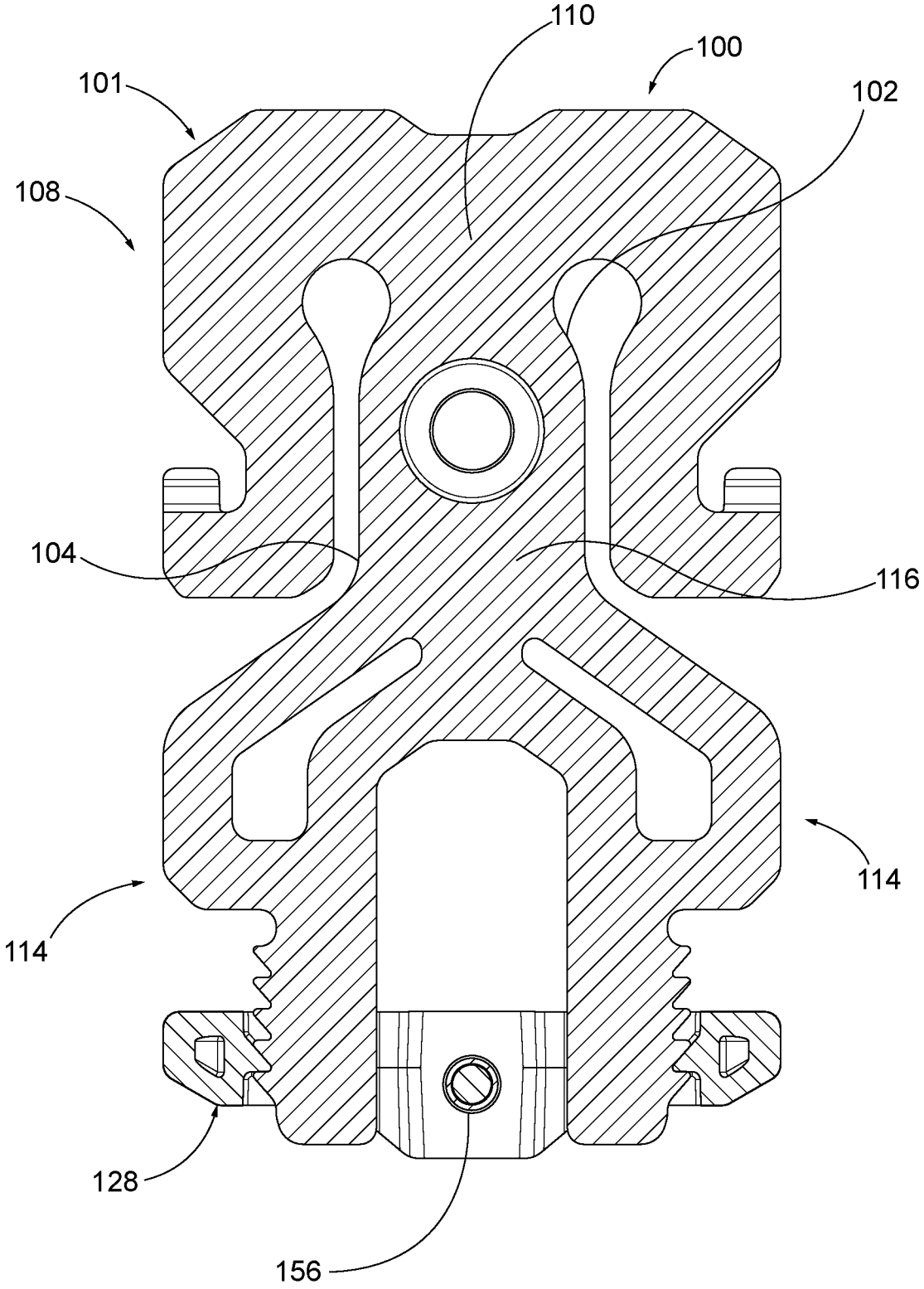
FIG. 11 is a cross-sectional view similar to FIG. 10 with the embodiment of the retainer in a different position on the lower tines.

In some embodiments, adapter assembly 100 includes a retainer 128 configured for slideable attachment to the lower tines 120 and for spanning the gap 124 between the lower tines 120. The retainer 128 may have one or more downwardly angled ratchet teeth 130, for example on opposing sides of an interior surface thereof configured to engage between a selected adjacent pair of teeth of the ratchet tooth structure 126 on corresponding lower tines 120 such that it is adaptable for multiple positions on the lower tines dependent upon which pair of adjacent teeth of the ratchet tooth structure the ratchet tooth 130 is engaged between (see FIGS. 10 and 11 showing different positions of the retainer 128 on lower tines 120). In some embodiments, the retainer 128 is configured for a one-way slideable locking engagement of the retainer 128 on the lower tines 120 such that the upwardly angled ratchet tooth structure 126 and the downwardly angled ratchet tooth 130 allow the retainer 128 to be slid upwardly on the lower tines 120 and prevent the retainer from being slid downwardly without manual compression of the lower tines 120, as discussed below. In other embodiments, the retainer 128 is configured for a two-way slideable locking engagement of the retainer 128 on the lower tines 120 such that the ratchet tooth structure 126 and the ratchet tooth 130 allow the retainer 128 to be slid upwardly and downwardly on the lower tines 120 without manual compression of the lower tines 120.

In some embodiments, retainer 128 is configured to be disengaged from the lower tines 120 or slid in a downwardly direction on the lower tines 120 upon manual compression of a lower tip portion 132 of the lower tines 120 towards one another decreasing the gap 124 between the lower tines 120 such that the ratchet tooth structure 126 is disengaged from the ratchet tooth 130.

Figure 6:
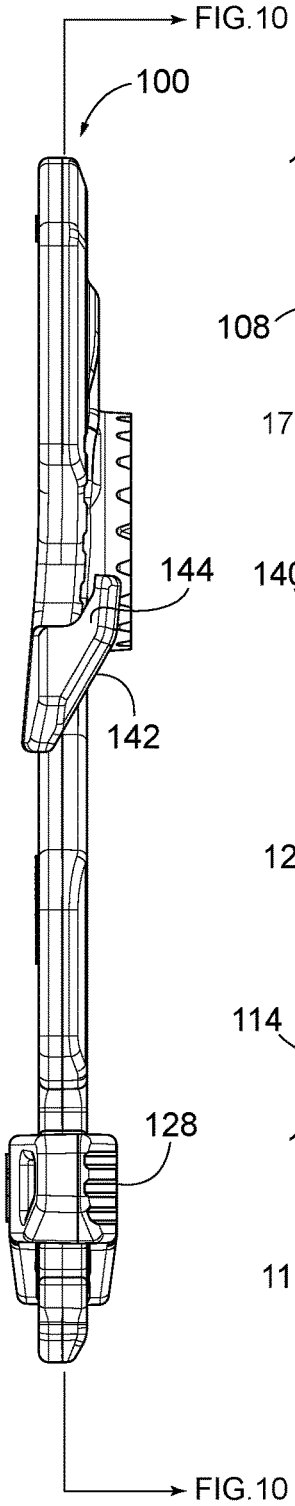
FIG. 6 is a left side view of the embodiment of the adapter assembly.
Figure 7:
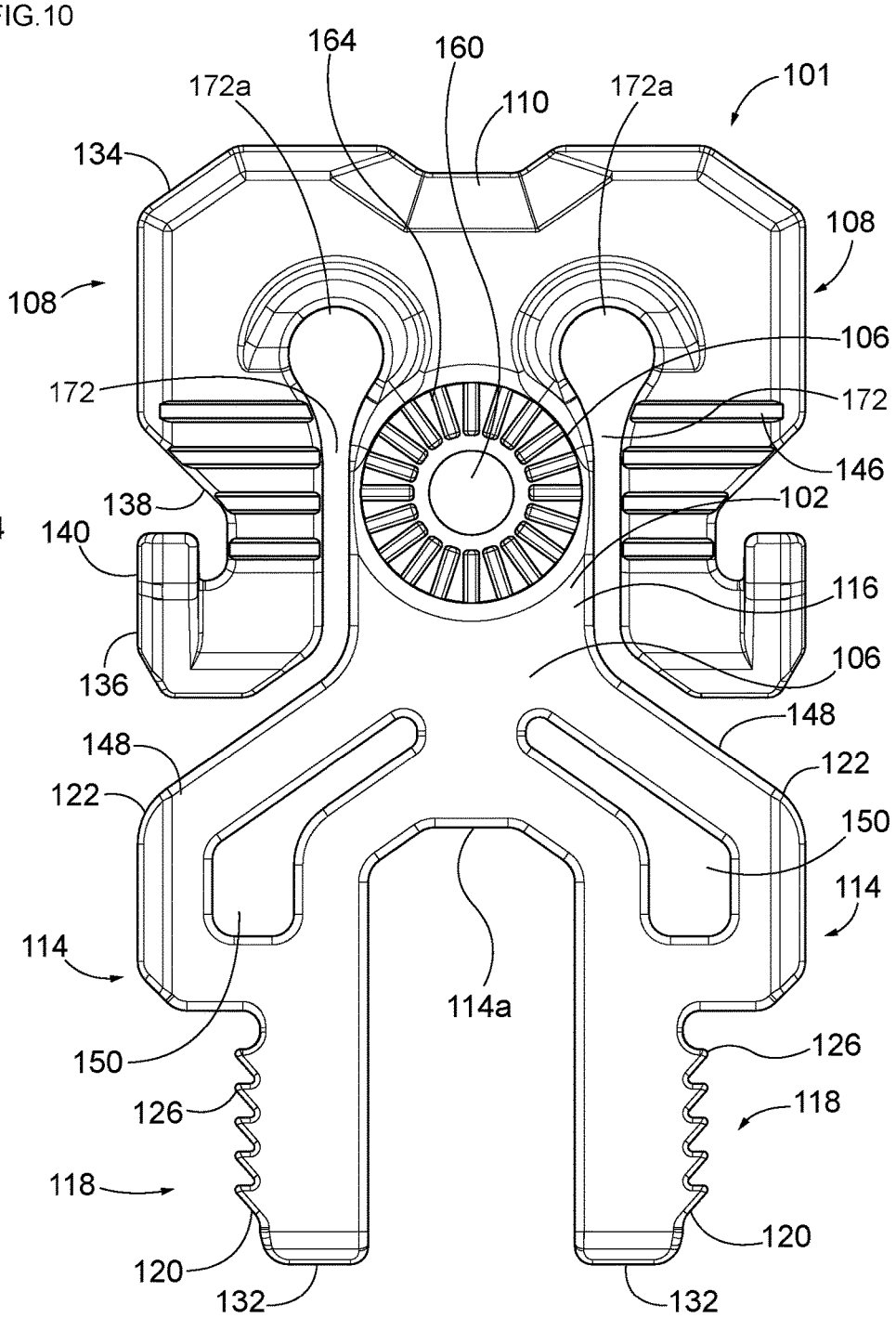
FIG. 7 is a front view of the embodiment of the adapter plate.

Referring to FIG. 7, in some embodiments, the upper arms 108 comprise an upper arm portion 134 and a lower arm portion 136; wherein the upper arm portions 134 are generally parallel with one another and spaced from the adapter body 102 such that strap-receiving slots 172 are formed between the upper arms 108 and the adapter body, and wherein the lower arm portion 136 of each upper arm 108 each have a narrowed portion 138 and a hook portion 140. Referring to FIG. 6, in some embodiments, the hook portion 140 comprises a first portion 142 extending frontward from a distal end of the narrowed portion 138 and a second portion 144 extending upwardly from the first portion 142. In some embodiments, the narrowed portion 138 comprises spaced horizontal ridges 146 on the rear surface thereof.

In some embodiments, the upper portion 122 of the lower legs 114 comprises laterally and downwardly extending shoulder portions 148 extending between the adapter body 102 and the lower tines 120, wherein each shoulder portion 148 comprises a cut-out portion 150 configured to reduce weight and allow flexing of the lower legs 114, for example upon manual compression of a lower tip portion 132 of the lower tines 120 towards one another decreasing the gap 124 between the lower tines 120 such that the ratchet tooth structure 126 is disengaged from the ratchet tooth 130.

In some embodiments, the retainer 128 comprises an elongated clam shell body 152 having a downwardly facing opening 154, and a through hole 156 extending between front and rear surfaces thereof, wherein the through hole is configured to receiving a locking screw 158.

Figure 8:
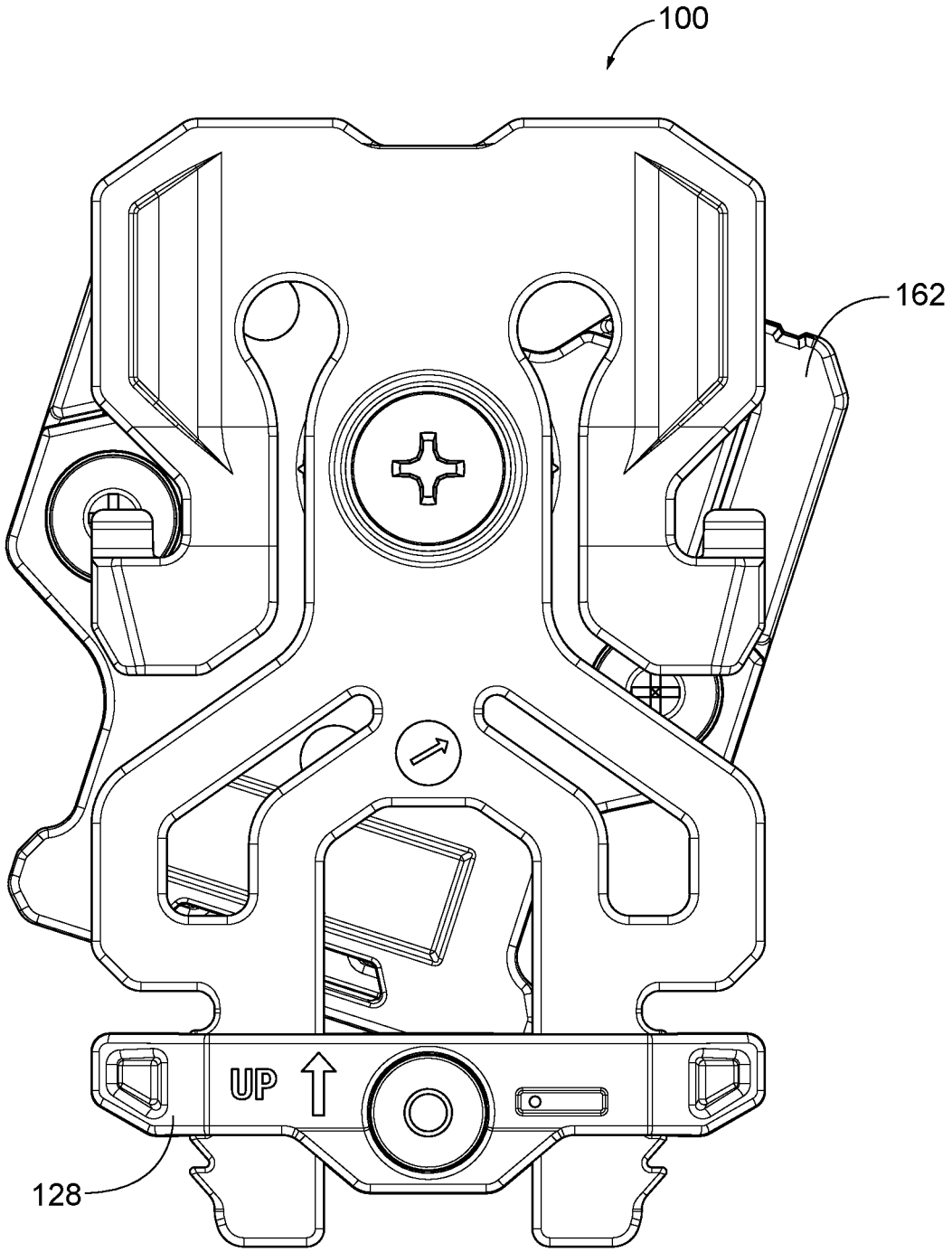
FIG. 8 is a rear view of the embodiment of the adapter assembly and an attachment assembly.
Figure 9:
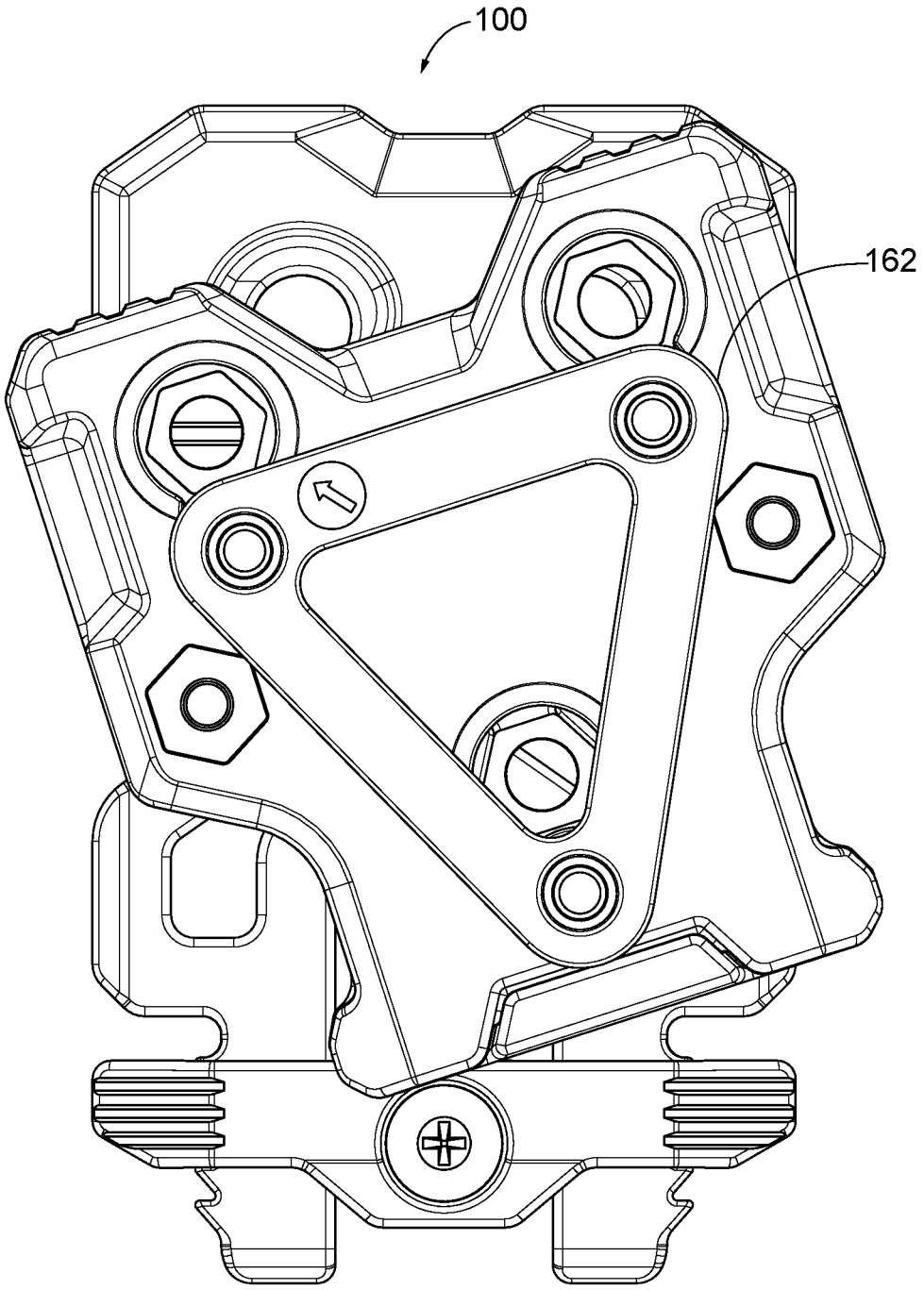
FIG. 9 is a front view of the embodiment of the adapter assembly and an attachment assembly.

Referring to FIGS. 7, 8 and 9, in some embodiments, the adapter body 102 comprises a through hole 160 extending from the front and rear surfaces, wherein the adapter body through hole 160 is configured for single point mount indexable attachment with an attachment assembly 162 for a holster or other accessory (not shown), wherein a ridged indexing ring 164 is provided on the front surface 106 of the adapter body 102 surrounding the adapter body through hole 160 and configured for indexable cooperation with the attachment assembly 162 for the holster.

Referring to FIG. 1, in some embodiments, the MOLLE/PALS system 112 comprises spaced rows of horizontal slots 166 forming strap portions 168 between the rows of horizontal slots 166 and column portions 170 between adjacent horizontal slots 166 forming a webbing arrangement. In some embodiments, each of the upper arms 108 and each of the lower legs 114 each has a width generally corresponding to the width of each horizontal slot 166 in order to prevent lateral movement of the adapter plate 101 when mounted in the MOLLE/PALS system 112. One of each pair of upper arms 108 and lower legs 114 is spaced apart a distance from the other in the respective pair of upper arms 108 and lower legs 114 allowing insertion into adjacent pairs of horizontal slots 166 and behind adjacent pairs of strap portions 168, and for lateral securement within the MOLLE/PALS system 112. In such arrangement, the respective pair of upper arms 108 are inserted into adjacent upper pairs of horizontal slots 166A and exit adjacent pairs of first intermediate slots 166B, while lower legs 114 are inserted into adjacent second intermediate slots 166C and exit adjacent pairs of lower slots 166D. The first and second portions 142, 144 of hook portion 140 are configured to project outwardly and upwardly to capture a lower edge 168A of a strap portion 168 for vertical securement, preventing vertical movement of the adapter plate 101 when mounted in the MOLLE/PALS system 112. The horizontal ridges 146 on the rear surface of the narrowed portion 138 are configured to engage the rear surface of the strap portion 168 between upper pairs of horizontal slots 166A and adjacent pairs of first intermediate slots 166B. This same strap portion 168 is captured between an upper armpit portion 172A of slots 172 and the hook portion 140 for vertical securement. In this manner, the strap portion 168 extends over upper arms 108, through the strap-receiving slots 172, and behind adapter body 102. The upper arms 106 straddle column portion 170. Strap portion 168 between the adjacent pairs of first intermediate slots 166B and adjacent pairs of second intermediate slots 166C pass entirely behind the adapter body 102 and upper portions of lower legs 122. Strap portion 168 between the adjacent pairs of second intermediate slots 166C and adjacent pairs of lower slots 166D passes over lower legs 114 and is trapped between a straddle portion 114A of the lower legs 114 where the upper portions of the lower legs 122 straddle the pair of adjacent second intermediate slots 166C, and the 128. The lower tip portions 132 of lower tines 120 rest on strap portion 168 below the adjacent pairs of lower slots 166D.

The lower tip portions 132 of the lower tines 120 are configured to rest on strap portion 168 below the adjacent pairs of lower slots 166D. In some embodiments, once the adapter plate 101 is in place, the gap 124 is disposed around a column portion 170. In some embodiments, once the adapter plate 101 is in place, the retainer 128 is configured to be inserted onto the lower tines 120 and locked in place by tightening locking screw 158 locking the adapter assembly 100 in place on the MOLLE/PALS system 112 providing both vertical and lateral securement of the adapter assembly 100 on the MOLLE/PAL system 112. As discussed above, since the retainer 128 is configured to be attachable to different positions on the lower tines 120, the adapter assembly 100 is configured to be adaptable to different sized strap portions 168 and still provide both vertical and lateral securement of the adapter assembly 100 on the MOLLE/PAL system 112. Retainer 128 can be pushed up the lower tines 120, while the downwardly angled ratchet tooth 130 engages successively higher teeth on the upwardly angled ratchet tooth structure 126 until the retainer 128 reaches the strap portion 168 above the adjacent pairs of lower slots 166D. The retainer 128 can be pushed as high as possible on the lower tines 120 for a more secure attachment to the MOLLE/PAL system 112.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. An adapter assembly comprising:
an adapter plate comprising:
a substantially planar adapter body, wherein the adapter body comprises a rear surface, a front surface; and
a spaced pair of lower legs integral with and extending downwardly from the lower portion of the adapter body, the spaced pair of lower legs comprising,
a spaced pair of generally parallel lower tines configured to have a gap there between, wherein the lower tines each comprise a ratchet tooth structure on an exterior surface thereof; and
a retainer configured for slideable attachment to the lower tines and for spanning the gap between the lower tines, the retainer comprising a corresponding ratchet tooth on an interior surface thereof configured to engage with the ratchet tooth structure for a one-way slideable locking engagement of the retainer on the lower tines, wherein the retainer is configured to be selectively locked in place on the adapter plate.

2. The adapter assembly of claim 1, the lower tines each further comprising a lower tip portion, and wherein the retainer is configured to be disengaged from the lower tines upon manual compression of a lower tip portion of the lower tines towards one another decreasing the gap between the lower tines.

3. The adapter assembly of claim 1, wherein at least the narrowed portion comprises spaced horizontal ridges.

4. The adapter assembly of claim 1, wherein the spaced pair of lower legs comprises an upper portion, and a lower portion, wherein the spaced pair of generally parallel lower tines extends generally downwardly from the upper portion of the lower legs, wherein the upper portion of the lower legs comprises laterally and downwardly extending shoulder portions extending between the adapter body and the lower tines, wherein each shoulder portion comprises a cut-out portion.

5. The adapter assembly of claim 1, wherein the adapter body comprises a through hole extending from the front and rear surfaces, wherein the through hole is configured for single point mount indexable attachment with an attachment assembly for a holster, wherein a ridged indexing ring is provided on the front surface of the adapter body surrounding the adapter through hole and configured for indexable cooperation with the attachment assembly for the holster.

6. The adapter assembly of claim 1, wherein the retainer is configured for attachment to the lower tines at multiple vertical positions on the lower tines.

7. The adapter assembly of claim 1, wherein the adapter body further comprises an upper portion and a lower portion, wherein the adapter plate further comprises:
a spaced pair of upper arms integral with and extending downwardly from the upper portion of the adapter body for removably securing said adapter assembly to equipment, wherein the upper arms comprise an upper arm portion and a lower arm portion; wherein the upper arm portions are generally parallel with one another.

8. The adapter assembly of claim 7, wherein the lower arm portions each have a narrowed portion and a hook portion, wherein each hook portion comprises a first portion extending frontward from a distal end of the narrowed portion and a second portion extending upwardly from the first portion.

9. The adapter assembly of claim 1, wherein the retainer comprises an elongated clam shell body having a downwardly facing opening, wherein the retainer further comprises a through hole extending between front and rear surfaces thereof, and wherein the through hole is configured for receiving a locking screw.

10. An adapter assembly comprising:

an adapter plate comprising:

a substantially planar adapter body, wherein the adapter body comprises a rear surface, a front surface, an upper portion, and a lower portion;

a spaced pair of upper arms integral with and extending downwardly from the upper portion of the adapter body for removably securing said adapter assembly to equipment; and a spaced pair of lower legs integral with and extending downwardly from the lower portion of the adapter body, the spaced pair of lower legs comprising, an upper portion, and a lower portion comprising a spaced pair of generally parallel lower tines extending generally downwardly from the upper portion of the lower legs, the spaced pair of lower tines configured to have a gap there between; and a retainer configured for slideable attachment to the lower tines and for spanning the gap between the lower tines, wherein the retainer is configured to be selectively locked in place on the adapter plate;

wherein the adapter body comprises a through hole extending from the front and rear surfaces, wherein the through hole is configured for single point mount indexable attachment with an attachment assembly for a holster, wherein a ridged indexing ring is provided on the front surface of the adapter body surrounding the adapter through hole and configured for indexable cooperation with the attachment assembly for the holster, wherein the ridged indexing ring comprises a plurality of spaced ridges surrounding the adapter through hole, wherein the ridged indexing ring is configured to provide adjustment of the angle of the adapter body relative to the attachment assembly for the holster about 360° in increments corresponding to angles between adjacent ridges of the ridged indexing ring.

11. The adapter assembly of claim 10, the lower tines each further comprising a lower tip portion, and wherein the retainer is configured to be disengaged from the lower tines upon manual compression of a lower tip portion of the lower tines towards one another decreasing the gap between the lower tines.

12. The adapter assembly of claim 10, wherein at least the narrowed portion comprises spaced horizontal ridges.

13. The adapter assembly of claim 10, wherein the upper portion of the lower legs comprises laterally and downwardly extending shoulder portions extending between the adapter body and the lower tines, wherein each shoulder portion comprises a cut-out portion.

14. The adapter assembly of claim 10, wherein the retainer is configured for attachment to the lower tines at multiple vertical positions on the lower tines.

15. The adapter assembly of claim 10, wherein the upper arms comprise an upper arm portion and a lower arm portion; wherein the upper arm portions are generally parallel with one another.

16. The adapter assembly of claim 15, wherein the lower arm portions each have a narrowed portion and a hook portion, wherein each hook portion comprises a first portion extending frontward from a distal end of the narrowed portion and a second portion extending upwardly from the first portion.

17. The adapter assembly of claim 10, wherein the retainer comprises an elongated clam shell body having a downwardly facing opening, wherein the retainer further comprises a through hole extending between front and rear surfaces thereof, and wherein the through hole is configured for receiving a locking screw.

* * * * *